United States Patent [19]

Tucker

[11] 3,983,817

[45] Oct. 5, 1976

[54] SPOTTING PROJECTILE

[75] Inventor: Henry G. Tucker, Westfield, Mass.

[73] Assignee: Remington Arms Company, Inc., Bridgeport, Conn.

[22] Filed: May 19, 1975

[21] Appl. No.: 575,049

[52] U.S. Cl. ..... 102/41; 102/60; 102/66; 102/87; 102/90; 102/92.7

[51] Int. Cl.[2] ..... F42B 13/20; F42B 13/36

[58] Field of Search ..... 102/41, 60, 65, 66, 102/87, 90, 92.7

[56] References Cited

UNITED STATES PATENTS

| | | | |
|---|---|---|---|
| 3,094,934 | 6/1963 | Anthony | 102/41 |
| 3,211,093 | 10/1965 | Stadler et al. | 102/87 X |
| 3,440,963 | 4/1969 | Deluca | 102/92.7 |
| 3,528,662 | 9/1970 | Merchant et al. | 102/92.7 X |
| 3,649,020 | 3/1972 | Hall | 102/92.7 X |

*Primary Examiner*—Verlin R. Pendegrass
*Attorney, Agent, or Firm*—John H. Lewis, Jr.; Nicholas Skovran; William L. Ericson

[57] ABSTRACT

A spotting projectile, especially for training purposes, which dispenses a cloud of powder upwardly on impact to indicate its location visibly. The projectile has an interior cylinder receiving a piston in gas-sealing slidable relation, so that gas trapped in the cylinder is compressed by forward inertial movement of the piston when the projectile impacts. The compressed gas ejects a powder charge carried by the piston rearwardly from the projectile to form a visible cloud.

12 Claims, 3 Drawing Figures

Fig. 1.
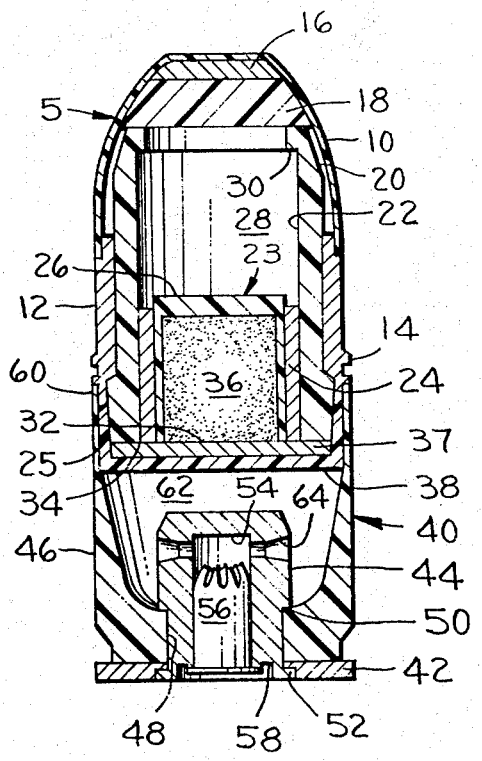
Fig. 2.
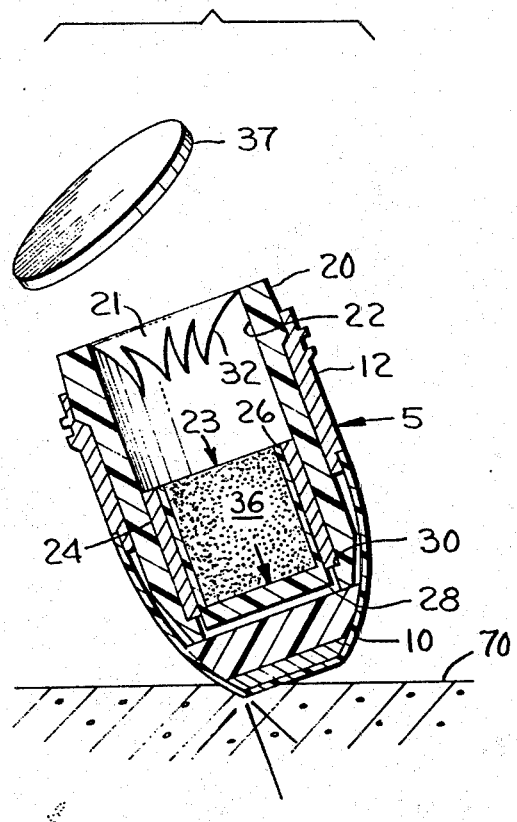
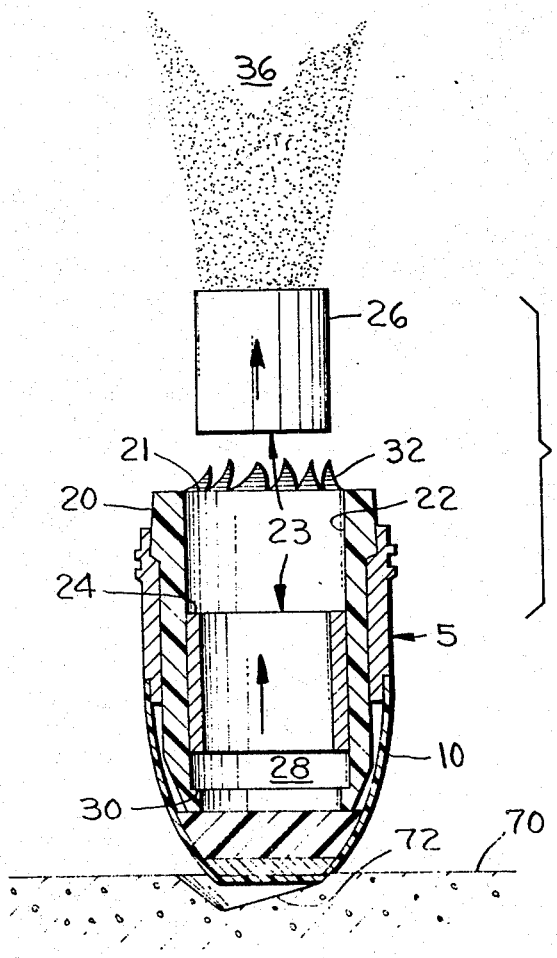
Fig. 3.

SPOTTING PROJECTILE

BACKGROUND AND BRIEF DESCRIPTION OF THE INVENTION

The present invention relates to projectiles of the type which disperse a quantity of fluent or powdered substance on impact. Such projectiles are used for the purpose of marking points of impact in training exercises, but may also be used in combat to disperse smoke, anti-personnel chemicals, and the like. The simplest approach to designing a projectile for this purpose is to enclose the spotting powder or other substance in a frangible case that bursts open when it strikes. However, this throws the powder forwardly on the ground, and the point of impact is not easily seen from a distance, especially on rolling or broken terrain. It is preferable to expel the powder upwardly and to the rear, to form a cloud extending some height above the ground.

One known method for doing this is to arrange an explosive cartridge and a container of spotting chemical in the projectile in such fashion that a nose impact blows the chemical out of a tube open to the rear. This is suitable for a large practice projectile such as a bomb or a large caliber shell in which space is not at a premium, and where the additional cost of the explosive cartridge and an impact-actuated firing pin mechanism may not be objectionable, but is not well adapted to small shells or grenades.

Still another known proposal has been to form the projectile of inner and outer telescoping members, of which the inner one is forced rearwardly at impact to compress a liquid container against a rear portion of the outer one, breaking the container and expelling the liquid through nozzles at the rear of the projectile. Apart from the cost of machining this complex device, the use of nozzles is not well suited to the ejection of particulate solid material, even if finely powdered. Further, since the telescoping stroke continues only during the interval between impact and arrest of the inner and outer members, an impact on soft earth or sand might not stop the inner member until the outer member had already made contact with the surface, so that the full stroke might not take place. This would be all the more probable because it is necessary to connect the inner and outer members by a detent strong enough to prevent relative motion during firing, and this must be broken by absorbing a large part of the impact energy before the telescoping stroke can begin.

The general object of the present invention is to increase the visibility of a spotting projectile by improving the dispersion of fluent or powdered materials from the projectile. Another object is to provide an improved spotting projectile which is less complex and expensive to produce than prior projectiles of which I am aware, and which is reusable. Further objects and advantages will appear as the following description proceeds.

Briefly stated, according to preferred embodiments thereof, I carry out my invention in part by forming a projectile casing with a longitudinal interior passage, preferably cylindrical in shape, which opens rearwardly to the exterior, but terminates forwardly in an enclosing wall behind the nose of the projectile. A piston is conformably and slidably received in gas-sealing relation within this passage to form an expansible chamber. The piston carries a quantity of spotting medium, which may for example comprise fluidized talcum powder or the like, with or without the addition of a fluorescent material.

In a preferred form, the piston includes a tubular sleeve member slidable in the casing passage, and a container for the spotting medium received conformably within the tubular member. The piston is initially located at the rear of the passage, where it rests against a cap which encloses the rear passage opening and is temporarily held on the casing by a weak cement, adhesive tape, or other suitable means. A pusher wad encloses the cap and the rear end of the casing, holding the cap and piston securely in place on the projectile as it is accelerated in the firearm barrel. The wad separates from the projectile, preferably shortly after it leaves the muzzle of the firearm; the cap remains in place during flight, but is knocked off by the impact of the projectile as it lands. The spotting-medium container is enclosed rearwardly by a frangible diaphragm, which may for example be formed of adhesive plastic tape, and is designed to burst open on impact.

As the projectile lands and instantly decelerates, the inertia of the piston drives it forcefully forward, compressing the air or gaseous medium in the interior passage. When the piston has decelerated, the container is expelled by the gas pressure through the rear opening of the casing, spewing the spotting medium out in a cloud. As the projectile generally lands with its nose inclined downwardly, this projects the cloud upwardly so that it becomes plainly visible from a considerable distance.

DESCRIPTION OF THE DRAWINGS AND THE PREFERRED EMBODIMENTS

While the specification concludes with claims particularly pointing out the subject matter which I regard as my invention, it is believed that a clearer understanding may be gained from the following description of preferred embodiments, referring to the accompanying drawings, in which:

FIG. 1 is a longitudinal cross-sectional view of a projectile of a preferred construction, assembled with a cartridge case and ready for firing;

FIG. 2 shows the projectile at the time of impact with the ground; and

FIG. 3 shows the expulsion of spotting medium and its container from the projectile a moment after impact.

Referring first to FIG. 1, the illustrated projectile 5 includes a composite casing comprising: a hollow ogive or nose 10 of any desired conventional shape; a tubular skirt 12, preferably of metal, which is formed exteriorly with circumferentially-extending bands 14 for purposes of obturating the firearm barrel to prevent the premature escape of propellant gases, and also for imparting spin to the projectile if fired from a rifled firearm barrel (not shown), as is well understood by those skilled in the art; internal nose elements 16 and 18 of metal or plastic, for the purposes of giving the projectile a weight and balance suitable for a desired ballistic behaviour, and for resisting deformation of the ogive in repeated firings; an internal tubular liner 20 having a longitudinal interior passage 22, which is preferably cylindrical in form; a cap 37; and a pusher wad or cup 38. Plastic resin is a convenient material for inexpensive molding of the ogive 10, nose element 18, liner 20, and wad 38. The passage 22 must be substantially straight, and may be bored or reamed after molding to attain a suitably accurate form. The elements of the casing are secured together by suitable means, e.g. by a shoulder 21 on the liner 20, by cement applied to joints between the elements, the threads, or simply by press fits at these joints.

A piston 23, comprising a tubular outer sleeve or member 24 and a cup-shaped container 26, is freely slidable as a unit along the passage 22. The sleeve 24 has a sliding gas-sealing fit in the passage 22, while the container 26 fits conformably in the interior of the sleeve, preferably with a compression sufficient to hold these parts in assembly until impact, when a substantial gas pressure is applied against the piston in opposition to its inertial force, in a manner which will shortly be described. Alternatively, the container 26 and sleeve 24 may be permanently attached, which produces a somewhat different result that will also be explained.

A sealed expansible chamber 28 is defined between the piston 23, the liner 20, and the forward wall formed by the nose element 18. Forward movement of the piston compresses the air or gaseous medium in the chamber 28, and is limited at the extreme by a shoulder 30 extending circumferentially about the forward end of the passage 22. The piston is initially located at the rear end of the passage as shown in FIG. 1, being held there by a layer 32 of material such as adhesive plastic tape, which overlies an exterior opening 21 (see FIGS. 2 and 3) at the rear end of the passage 22, as well as a rear edge 34 of the liner 20. The layer 32 also forms a frangible diaphragm or cover over a rearward open end of the cup-shaped container 26, which receives a quantity of any suitable liquid or particulate solid spotting medium 36, such as fluidized talcum powder, with or without the additions of a fluorescent powder and a desiccant material such as a silica gel.

The projectile 5 is assembled with a cartridge case 40, which may be of any conventional type suitable to the design and intended use of the projectile, but is illustrated as a known composite plastic and metal type incorporating a metal extraction rim 42, a metal high pressure chamber member 44, and a tubular plastic case element 46. These parts are assembled by elastic expansion of an opening 48 in the base of the element 46, and secured between a shoulder 50 and a flange 52 extending circumferentially about the member 44. A blind bore 54 is formed in the member 44 and comprises a high pressure chamber of a diameter to receive a blank cartridge 56 of appropriate size to propel the projectile 5. A recess 58 in the base of the member 44 provides for convenient extraction and replacement of the cartridge 56. The base of the projectile 5 is received with a suitably tight fit in the mouth 60 of the cartridge case, with the wad 38 sealing a chamber 62 which communicates with the bore 54 through nozzles 64 circumferentially spaced about the member 44.

After loading the assembled round in a suitable firearm (not shown), the blank cartridge 56 is fired, and the resulting powder gases propel the projectile 5 out of the case 40 and through the barrel of the firearm. The wad 38 is preferably of a known design that falls or strips away from the projectile shortly after it leaves the firearm muzzle, which is facilitated by the frusto-conical surface 25 at the rear end of the liner 20; but it is permissible for it to remain in place during the flight of the projectile and be knocked off by the ensuing impact.

FIG. 2 shows the projectile 5 at the end of a typical flight, a moment after initial contact with a horizontal surface 70. The cap 37 has been knocked off by the impact, and the projectile has been decelerated almost instantly. The inertia of the piston 23 has forced it to slide in the direction shown by the arrow, downwardly in the passage 22, compressing the air confined in the expansible chamber 28 to a pressure substantially higher than atmospheric pressure. The suction created behind the piston 23, the initial adhesion of the diaphragm 32 to the piston, and the impact force have combined to burst the diaphragm inwardly. The piston may or may not travel all the way to the shoulder 30 as shown, depending on the mass of the piston, the rate of projectile deceleration, and the effective compression ratio resulting from the proportion of the length of stroke to the initial length of the expansible chamber 28. Also, the container 26 may not travel so far toward the nose of the projectile as the sleeve 24, depending upon the tightness of the compression fit between these parts and the amount of pressure produced, but may start to slide rearwardly out of the sleeve while the latter is still traveling in a forward direction.

The projectile is shown a moment later in FIG. 3, starting to tumble out of the depression 72 produced by the impact; obviously the behaviour of the projectile after the instant of initial contact may vary a great deal, depending on the nature of the target it strikes, the angle of impact, and so forth, and FIG. 3 is merely an illustrative example. The piston having completed its downward travel and come to a halt at the moment of FIG. 2, the compressed air in the chamber 28 drives the piston rearwardly and upwardly as shown by the arrows, along the passage 22. The sleeve 24 has a smaller frontal area than the container 26, and also is preferably made of metal or other relatively dense material such that it has a substantially greater mass than the light plastic container and its powder charge 36, with the result that the container is forcibly expelled out of the sleeve and through the rear opening 21, while the sleeve may travel only part way up the passage. The powder 36 is thrown upwardly and forms a visible cloud.

Optionally, the sleeve 24 and container 26 may be permanently secured together, or may be integrally formed, provided that the piston weight and area are such that either the entire piston 23, or at least the powder 36, will be expelled out of the projectile upon impact. However, the preferred embodiment shown in the drawings has the advantage of applying the full piston mass to pressurize the chamber 28 on the downward stroke, then utilizing a substantial part of the energy of compression to accelerate the lighter mass of the powder and its container as a separate body. This results in a higher powder velocity, and consequently propels the spotting cloud to a greater height, than a non-separating piston construction.

It should be noted that I have experimented with spotting projectiles in which a quantity of loose spotting powder is placed directly in the passage 22 of the projectile, and the composite piston 23 is replaced by either a solid piston, or a piston with one or more longitudinal rearwardly-opening ports closed initially by a frangible diaphragm. I have found these arrangements less satisfactory than providing a separate enclosure for the spotting powder, partly because the presence of powder in the passage tends to inhibit sliding motion of the piston by causing excess friction. Also, the spotting powder is ejected only by the turbulent escape of the compressed air from these projectiles, which does not create as effective a dispersion or as high a cloud as the illustrated design.

What I claim is:

1. A spotting projectile comprising:

a casing having a longitudinally-extending interior passage terminating rearwardly in an exterior opening and terminating forwardly in a wall-forming casing portion;

piston means mounted in said passage for sliding motion longitudinally therein, said passage, piston means, and wall-forming portion defining a gas-sealing expansible chamber therebetween;

said piston means initially being located rearwardly in said passage and being inertially slidable forwardly therein upon impact and deceleration of the projectile, to compress a gaseous medium confined in said expansible chamber;

said piston means being constructed and arranged to releasably support a quantity of spotting medium for expulsion and release through said rearward exterior opening by the compressed gaseous medium following forward sliding of said piston means in said passage.

2. A spotting projectile as recited in claim 1, in which said piston means comprises container means adapted to receive a quantity of spotting medium, said container means being constructed and arranged for expulsion by the compressed gaseous medium through said rearward exterior opening and concurrent release of the spotting medium.

3. A spotting projectile as recited in claim 2, said container means being enclosed rearwardly by frangible diaphragm means rupturable upon impact of said projectile.

4. A spotting projectile as recited in claim 2, said piston means further comprising a member separable from said container means by relative motion therebetween longitudinally of said passage.

5. A spotting projectile as recited in claim 4, said piston means having forwardly-exposed surfaces occupying substantially the entire cross-sectional area of said passageway to enclose said expansible chamber, said container means and said member forming different portions of said forward surfaces and being subject individually to pressure exerted by compressed gaseous medium in said expansible chamber.

6. A spotting projectile as recited in claim 5, said member forming a smaller portion of said forward surfaces than said container means.

7. A spotting projectile as recited in claim 5, said member having a greater mass than said container means.

8. A spotting projectile as recited in claim 1, in which said piston means comprises a sleeve member conformably and slidably received within said passage, and container means conformably received within said sleeve member and adapted to contain a quantity of spotting medium.

9. A spotting projectile as recited in claim 8, said container means being slidably separable from said sleeve by application of a force of predetermined magnitude acting therebetween in a direction longitudinal to said passage.

10. A spotting projectile as recited in claim 8, said passage and said sleeve member having conformable cylindrical surfaces of a first diameter engaging one another in longitudinally-slidable relation, and said sleeve member and said container means having conformable cylindrical surfaces of a second smaller diameter engaging one another in longitudinally-slidable relation.

11. A spotting projectile as recited in claim 1, together with means initially covering said rearward opening to retain said piston means in said passage, and constructed and arranged for separation from said casing upon impact of said projectile with a target.

12. A spotting projectile as recited in claim 1, together with means initially engaging a rearward end of said casing and covering said rearward opening to retain said piston means in said passage, and constructed and arranged for separation from said casing upon launching said projectile from a firearm.

* * * * *